United States Patent [19]

Gnau et al.

[11] Patent Number: 5,044,189

[45] Date of Patent: Sep. 3, 1991

[54] SCRAP GUIDING AND CHOPPING IN A SHELL PRESS

[75] Inventors: Kenneth P. Gnau, Beavercreek; Stephen P. Common, Dayton, both of Ohio

[73] Assignee: Dayton Reliable Tool & Mfg. Co., Dayton, Ohio

[21] Appl. No.: 467,472

[22] Filed: Jan. 19, 1990

[51] Int. Cl.[5] ..... B21D 28/02

[52] U.S. Cl. ..... 72/336; 72/405; 72/339; 83/923; 413/56

[58] Field of Search ..... 72/336, 329, 333, 335, 72/337, 339, 328-330, 405; 83/105, 102, 420, 923; 413/56

[56] References Cited

U.S. PATENT DOCUMENTS

| | | | |
|---|---|---|---|
| 1,725,300 | 8/1929 | Pierson | 72/328 |
| 3,003,447 | 10/1961 | Gavazzi | 72/328 |
| 3,315,512 | 4/1967 | Maciorowski | 72/330 |
| 3,369,387 | 2/1968 | Bradlee | 72/405 |
| 3,589,221 | 6/1971 | Deegan | 83/923 |
| 3,799,020 | 3/1974 | Hoelmer | 83/923 |
| 4,561,280 | 12/1985 | Bachmann | 72/336 |
| 4,567,746 | 2/1986 | Bachmann | 72/336 |
| 4,770,022 | 9/1988 | Cook | 72/405 |
| 4,914,996 | 4/1990 | Lavorel | 72/336 |

*Primary Examiner*—Daniel C. Crane

*Attorney, Agent, or Firm*—Joseph G. Nauman

[57] ABSTRACT

A method and apparatus are disclosed for making and transferring shells for cans within a ram press. The shells are formed in a two-step operation in which shell preforms are formed at a first station within the press and then transferred to second station where they are formed into completed shells. The first station includes first and second rows of tooling sets with the tooling sets of the first row being located in alternating transverse positions relative to the tooling sets of the second row. Similarly, the second station includes third and fourth rows of tooling sets in which the tooling set of the third row are located in alternating transverse positions relative to the tooling sets of the fourth row, and the tooling sets of the third and fourth rows are located for receiving the shell preforms from the tooling sets of the second and first rows, respectively. The shell preforms formed in the first row are transferred along a lower transfer level within the press to the fourth row tooling, and the shell preforms formed in the second row are transferred along an upper transfer level within the press to the third row tooling. In addition, a guide path and chopper mechanism are provided for removing from the press scrap skeleton material remaining from a sheet of stock material used in the formation of the shell preforms in the first station.

14 Claims, 6 Drawing Sheets

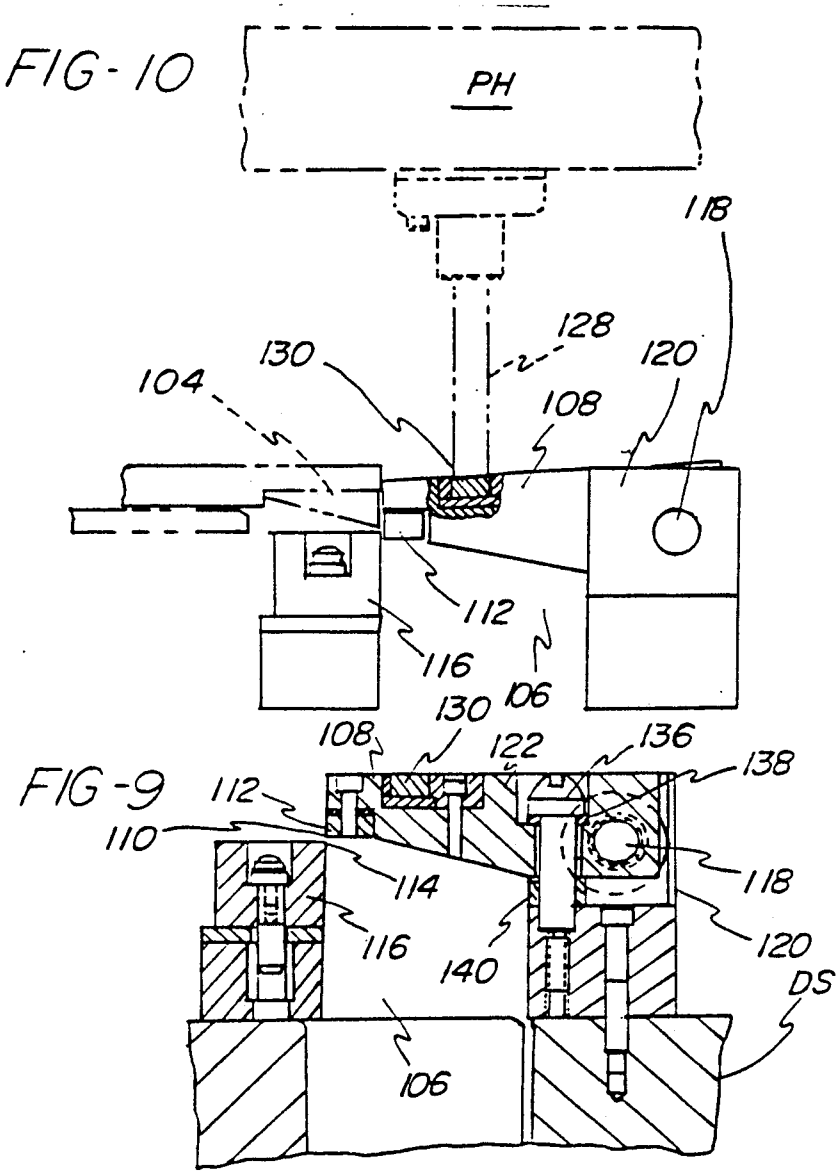
FIG-10
FIG-9
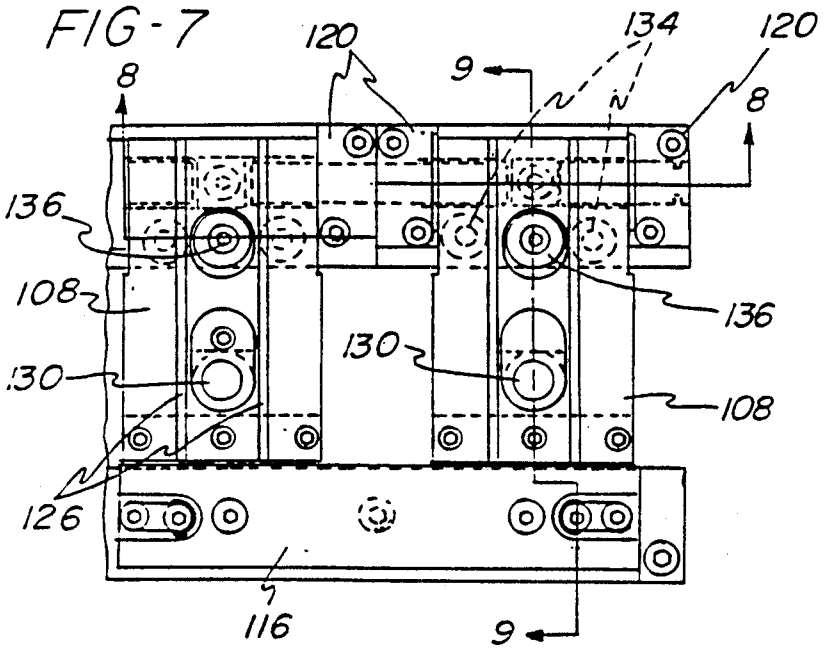
FIG-7
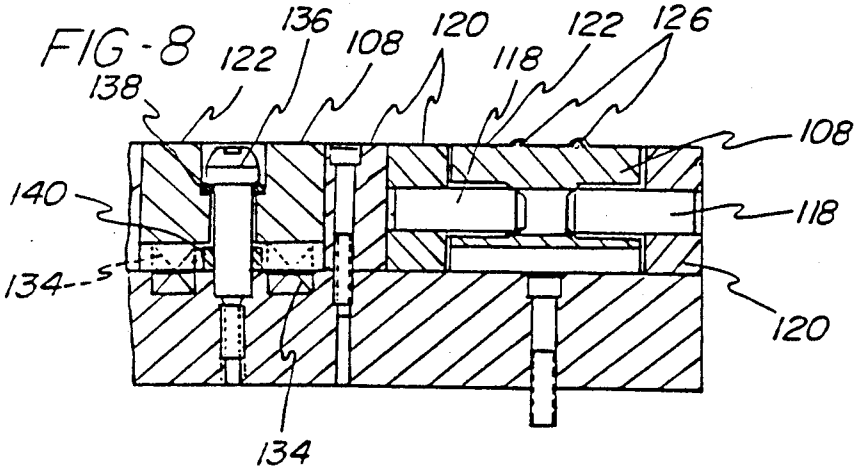
FIG-8

SCRAP GUIDING AND CHOPPING IN A SHELL PRESS

CROSS-REFERENCE TO RELATED APPLICATIONS

This subject matter of this application is related to the subject matter of U.S. applications Ser. No. 467,811 entitled Transfer Plate Lifts for Shell Press and Ser. No. 467,818 entitled Method and Apparatus for Making and Transferring Shells for Cans, both filed on the same data as this application and assigned to the same assignee.

BACKGROUND OF THE INVENTION

The present invention relates to a method and apparatus for the formation of shells to close the ends of metal cans and, more particularly, to a method and apparatus for forming shells for can ends at two stations contained within the same press and for transferring the shells between the stations.

One common way of packaging liquids such as soft drinks, beer, juices and the like, is within cans typically formed from aluminum. In such cans, a unitary or deep drawn can body is usually manufactured to include the can side walls, as well as an integral bottom. Other cans may have a coated metal seamed body, with a separate attached bottom which might be in the form of a shell such as is used for forming the can top, as is described further below. In either event, the upper end, which includes the means by which the can is later opened, is manufactured separately and attached to the can body after the can has been filled. These so-called easy-open or "pop-top" ends are made from a shell which is converted to an end by appropriate scoring and attachment of a pull tab by integral riveting techniques. The shells are manufactured from sheet metal by severing a suitable blank from a strip of stock material, forming the blank to define a central panel, surrounded by a reinforcing countersink and chuckwall configuration and a shell curl which is designed to interact with a body curl of a can during sealing of the can. The blank may be of the type disclosed and claimed in commonly assigned U.S. Pat. No. 4,637,961.

The shells may be formed in a two-stage operation in which a shell preform is formed at a first station and the preform is transferred to a second station where it is subsequently reformed into a completed shell. In known methods of shell production, a blank is removed from a strip of stock material wherein the shell preform is formed in a first stroke of the press ram and the shell preform is reformed into a completed shell at the second station in a subsequent stroke of the press ram.

A transfer system is provided for transferring the shells from the first to the second station during opening of the tooling in the press. In one approach, the shell preform formed within the first tooling station is vertically positioned for transfer and a device is actuated to strike the shell with an edgewise blow that propels it outwardly from the tooling. Alternatively, a shell which is positioned for transfer may be struck from the side by a stream of pressurized gas issuing from an orifice positioned adjacent to the shell.

Examples of these types of transfer systems may be seen in U.S. Pat. Nos. 4,561,280 and 4,770,022. In these patents, when the actuator or gas stream strikes the shell, the shell is caused to move along the transfer path. Ideally, the shell moves in free flight without contacting any portions of a restraining structure defining the path until the shell is captured at the second station. In addition, a cushion of air may be provided along the lower portion of the shell path in order to minimize contact between the shell and the surface in the tooling defining the transfer path.

Various tool lay-out modifications for the first and second tooling stations are disclosed in U.S. Pat. No. 4,567,746 and which may incorporate the transfer systems described above. This patent shows tooling lay-outs which may operate on stock material moving either from the front to the rear of the press or from side to side through the press. For example, the lay-out shown in FIG. 12 of this patent shows the material being fed from the front to the rear of the press with the first stations located over the stock material at the center of the press and the second stations located to either side of the stock material such that the transfer mechanism transfers the preformed shells sideways to the second stations.

In the lay-out shown in FIG. 13 of the '746 patent, the stock material is transferred from side to side through the press and the first stations are located over the stock material near a front portion of the press and the second stations are located adjacent to the stock material near a rear portion of the press. The tooling lay-outs for the above presses are arranged such that after passing through the first stations the scrap stock material remaining from the formation of the shell preforms is passed out of the press into a suitable chopper. It should be noted that the tooling is arranged such that after passing the first stage tooling, the web of scrap material will pass out of the press without intersecting the second tooling such that the web does not interfere with the transfer of the shell preforms or the operation of the tooling at the second station. As a result of this constraint on the tooling arrangement, the width of stock material available for a given press bed size is limited by the need to provide sufficient room for the second tooling and for removal of the scrap web, and thus the entire working area of the press bed is not utilized to its fullest potential.

In order to increase the output rate of the above-described press lay-outs, either the operating speed of the press must be increased such that more shells may be produced per unit of time from a given size of stock material, or the bed size of the press must be increased to accommodate a larger width of stock material and additional tooling stations, with consequent larger tooling.

It can be seen, therefore, that a tooling lay-out for a two-stage press is needed wherein the area of the press bed is fully utilized such that the number of shells produced per press stroke is maximized. Further, a tooling lay-out is needed for maximizing the output of the press while efficiently removing scrap metal, so as not to interfere with the transfer of shell preforms or the operation of the second shell forming stations.

SUMMARY OF THE INVENTION

The present invention provides a method and apparatus for the formation of shells to close the ends of metal cans. A sheet of thin metal is incrementally fed to a first station, at which a generally circular blank is separated from the sheet and partially formed into the shell. The partially formed shell is then transferred from the first station along a predetermined path by means of a stream of pressurized gas which strikes the partially formed shell from the side and causes it to be propelled toward a second station where the formation of the shell is completed.

Shell formation, as outlined above, is performed within a conventional ram press, with the first and second stations each including tooling operated by the press ram. Operations at the first and second stations occur simultaneously, so as a shell is completed within the second station, the immediately succeeding shell is being initially formed within the first station. The transfer between successive stations is accomplished sufficiently quickly for a shell initially formed within the first station by a first stroke of the press ram to be positioned for final formation within the second station by the next succeeding stroke.

The first station includes parallel first and second rows of tooling sets in which the tooling sets of the first row and second row are offset relative to one another in a direction transverse to the direction in which the sheet material is fed into the press such that the centers of the first and second row tooling sets are positioned in a staggered or zig-zag pattern across the width of the press. Each of the first and second rows of tooling sets includes upper first and second rows of tooling connected to the ram and cooperating lower first and second rows of tooling, respectively, supported on the base of the press.

Similarly, the second station includes third and fourth rows of tooling sets arranged in a staggered or zig-zag pattern similar to that of first and second rows of tooling. Each of the third and fourth rows of tooling sets includes upper third and fourth rows of tooling connected to the ram and cooperating lower third and fourth toolings, respectively, supported on the base of the press. The third row tooling sets are positioned to receive partially completed shells from the second row tooling sets and the fourth tooling sets are positioned to receive partially completed shells from the first row tooling sets.

The press further includes lower and upper transfer plates provided with means forming transfer paths wherein the transfer from the first to fourth row sets of tooling occurs along the transfer paths on the lower transfer plate and the transfer from the second to the third sets of tooling occurs along the upper transfer plate. A stream of pressurized gas for propelling the shells from the tooling sets is supplied by a nozzle located adjacent to each of the tooling sets. An air manifold is associated with each of the rows of tooling sets for providing the pressurized gas to the nozzles.

In addition, the upper tooling for each of the tooling sets is provided with means for producing a partial vacuum along a bottom surface thereof for holding the shell on the upper tooling as the upper tooling separates from the lower tooling. When the upper tooling for the first and second rows has moved the partially completed shells into position adjacent to the nozzles, the manifold associated with that particular row of tooling is supplied with pressurized gas to overcome the retaining force of the vacuum holding the shells on the upper tooling and to simultaneously propel all the shells on that particular row along the transfer paths. In a similar manner, the nozzles for the third and fourth rows are actuated to propel the completed shells from the press.

The sheet of thin material used for forming the shells is incrementally conveyed into the press along an upper portion of a stock support plate at the front of the press and beneath a front portion of the lower transfer plate. The tooling sets of the first and second rows are spaced from adjacent ones of tooling sets in the same row by a distance slightly less than the diameter of the blank removed from the sheet material, and as mentioned above, the centers of the tooling sets of the first row of tooling are located in transversely alternating positions with respect to the tooling sets of the second row of tooling such that a maximum number of shell blanks may be removed from the sheet material with a minimum of waste. After the sheet material has been punched by the second row of tooling sets, the remaining web or scrap skeleton continues to pass under the front portion of the lower stripper plate until it reaches a rearward end of the stock support plate where it is conveyed downwardly out of the press between the second and third rows of tooling sets.

As the thin sheet of material is conveyed downwardly a plurality of chopper plates are intermittently actuated by a plurality of drive bars extending downwardly from the press ram such that blades mounted to a lower surface of the chopper plates chop the scrap skeleton into narrow elongated pieces which fall into a scrap chamber. The strips of scrap are removed from the scrap chamber by means of a venturi nozzle located at the end of the press scrap chamber on one side of the press whereby the scrap strip is forcibly removed from the chamber by high velocity air moving from one side of the chamber to the other.

By locating the transfer paths of the first and second rows of tooling sets on different vertical levels, it is possible to slightly overlap the location of the tooling sets for the first and second rows in a direction transverse to the direction of conveyance of the sheet material, while maintaining a sufficient center-to-center transverse spacing between the tooling sets of each of the rows to permit partially completed shells from the first row to pass between adjacent stations in the second row, such that a punch pattern is formed on the sheet material which maximizes the use of the material. Further, by conveying the sheet material on a level beneath the lower transfer level, it is possible to remove the scrap material from the press without interfering with the transfer of the partially completed shells from the first to the second stations.

BRIEF DESCRIPTION OF THE DRAWINGS

FIG. 7 is a plan view of two of the chopper plates and a cooperating chopper block of the preferred embodiment of the present invention;

FIG. 8 is a sectional view taken along line 8—8 of FIG. 7;

FIG. 9 is a sectional view taken along line 9—9 of FIG. 7; and

FIG. 10 is an elevational view of the chopper mechanism of the present invention being actuated by the chopper plate drive bar.

DETAILED DESCRIPTION OF THE PREFERRED EMBODIMENT

Figure 1:
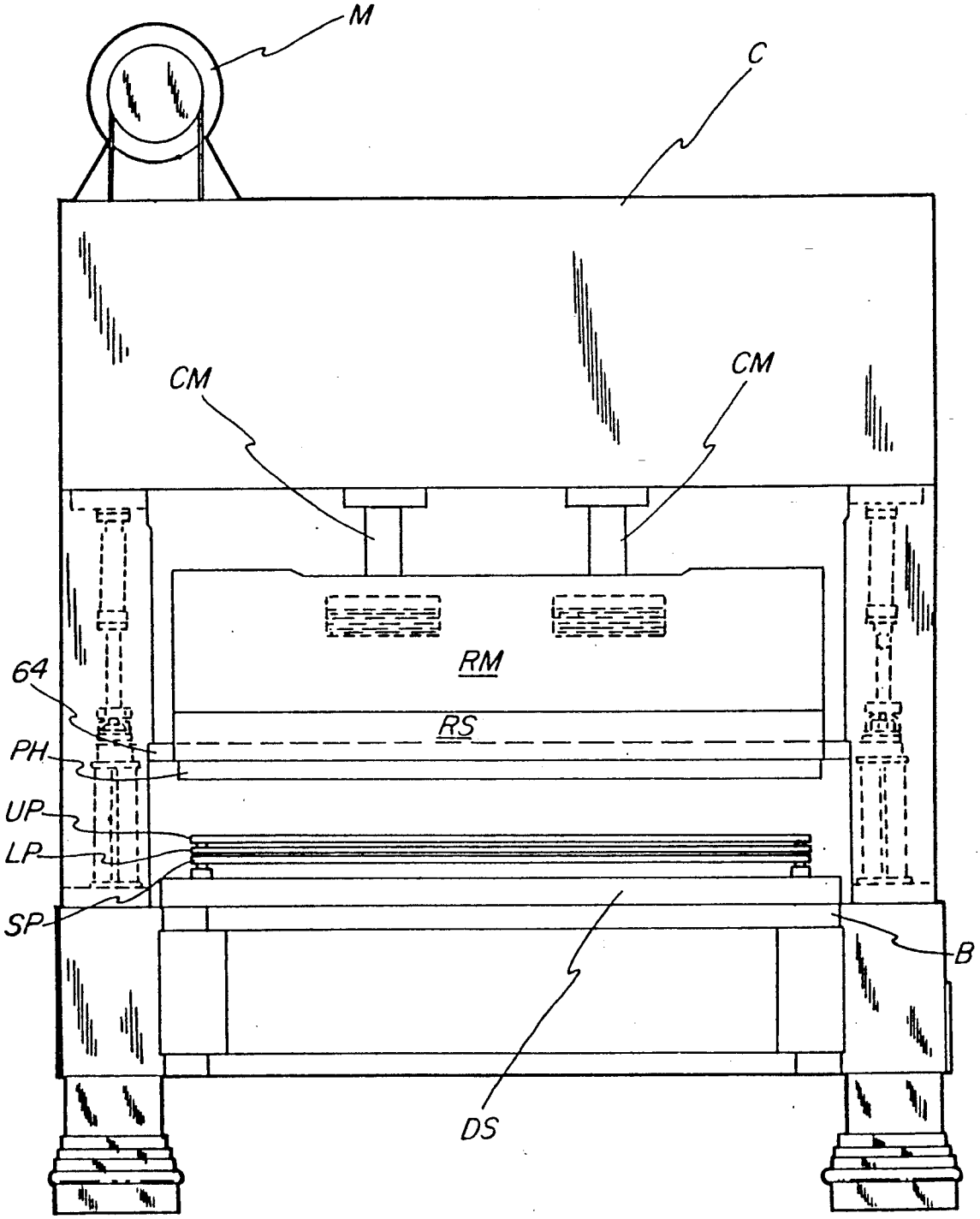
FIGS. 1 and 2 are, respectively, front and side views of a typical ram press as utilized in the present invention.
Figure 2:
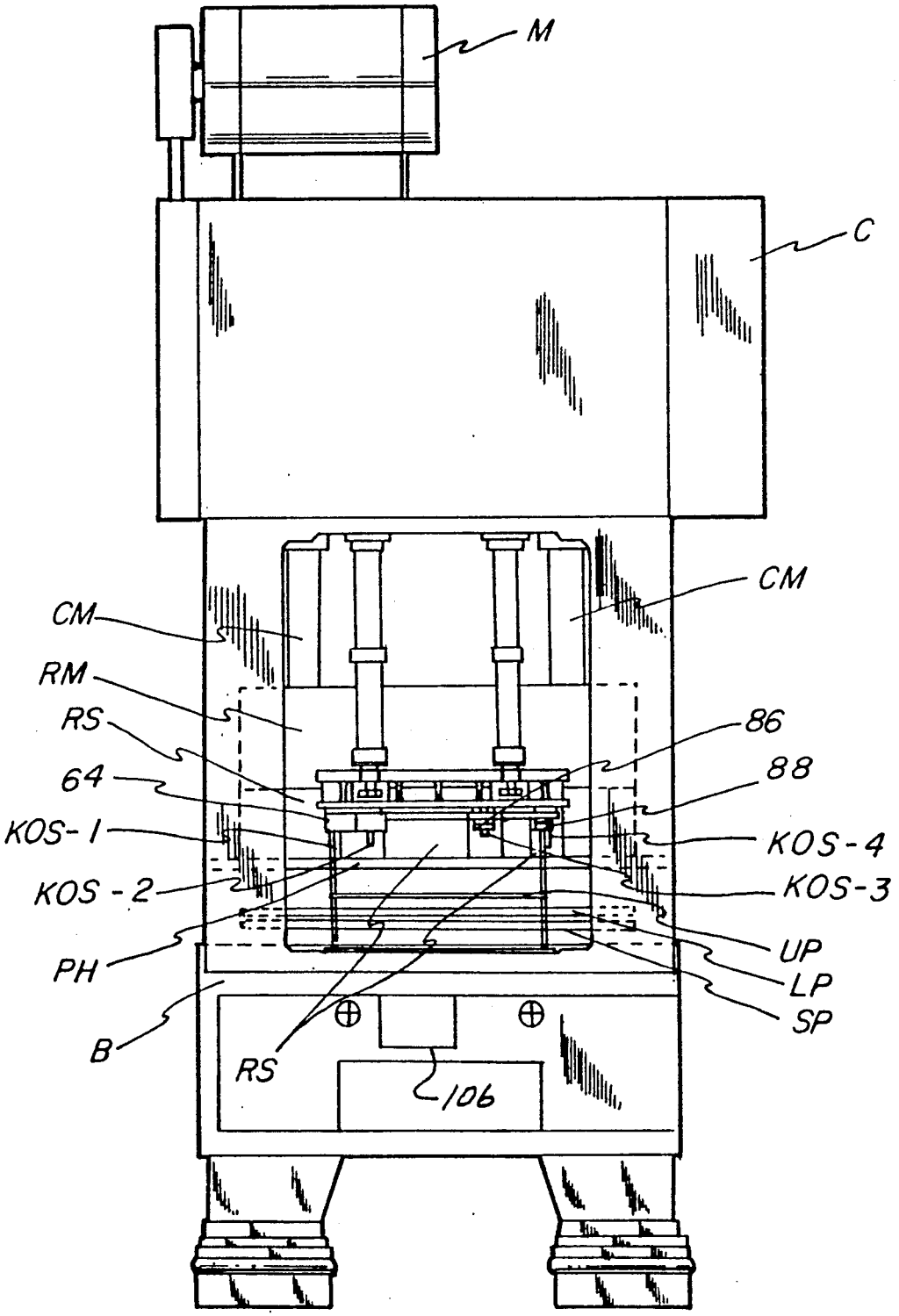

Referring now to the drawings, a typical ram press used in the manufacturing of shells for can ends might be a Minster SAS4-H125-90 press, the outline and layout of which is shown in FIGS. 1 and 2. The press includes a drive motor M mounted on the top of the crown C of the press for driving a ram RM in reciprocating motion through a set of four cylinder members CM extending down from the crown C. The ram is guided in its reciprocating motion by the side guides (not shown) which are part of the press structure, and additional guiding is provided by conventional ball bearing and bushing guides (not shown) at each of the four corners of the ram. A punch holder PH is supported from the lower surface of the ram for supporting the upper portion of a tooling set provided for the formation of shells. The punch holder is spaced from the lower surface of the ram by a set of spaced risers RS which extend across the width of the ram.

The press further includes a bed B which supports a die shoe DS for mounting the lower tooling of the tooling set for forming the shells. The die shoe DS supports an upper transfer plate UP, a lower transfer plate LP and a stock support plate SP which are provided for purposes to be described below.

The present invention is not dependent upon any specific method of shell formation, so long as the shells are at least partially formed with the ram press at a first location within the press and subsequently formed into a completed shell for use in forming can ends at a second location within the press. In the preferred embodiment, a thin sheet of metal stock material SM is fed incrementally into the press at a stock feed level between the stock support plate SP and the lower transfer plate LP until the stock material SM is aligned with a set of first stations where a substantially circular blank is punched out of the sheet material SM and formed into a shell preform by cooperating upper and lower die sets. The shell preform is then transferred to a point where it is aligned with a second station, where a second set of cooperating upper and lower tooling form the shell preform into a completed shell, and the completed shell is then transferred from the press. In addition, after the stock material SM leaves the first station tooling, the remaining scrap material is transferred out of the press at a point intermediate the first and second tooling stations.

Figure 3:
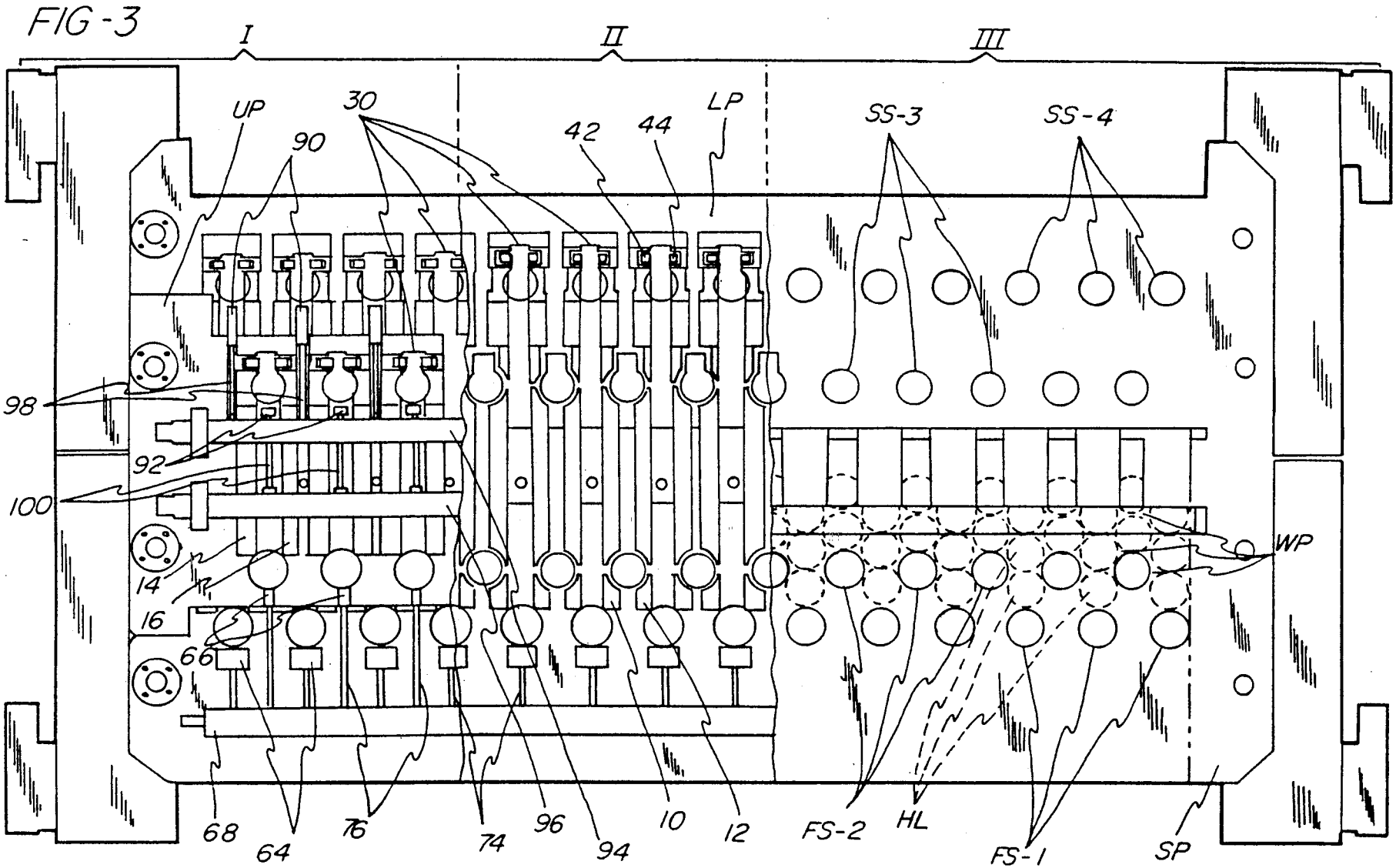
FIG. 3 is a plan view of the transfer apparatus of the present invention in which area I shows the transfer apparatus with both the upper and lower transfer plates in place, area II shows the transfer apparatus with the upper transfer plate removed and with the positions of the lower level guide rails shown, and area III shows the transfer apparatus with both the upper and lower transfer plates removed and with the path of the scrap skeleton shown.

As may be seen in FIG. 3, the tooling for the present invention may be arranged in four parallel rows including first and second rows FS-1 and FS-2, respectively, at the first station, and third and fourth rows SS-3 and SS-4, respectively, at the second station. The tooling of the second row FS-2 is offset relative to the tooling of the first row FS-1 in a direction transverse to the direction in which the stock material SM is fed into the press such that the centers of the tooling of the first and second rows are positioned in a staggered or zig-zag pattern across the press. Further, the tooling of the first and second rows are spaced from immediately adjacent tooling in the same row by a distance slightly less than the diameter of the blank removed from the stock material.

Area III of FIG. 3 shows the pattern formed on the stock material by the two rows of first station tooling and in which it may be seen that the holes HL left in the stock material SM are joined by thin web portions WP such that the amount of material in the scrap skeleton resulting from the blanking operation is minimized. The tooling of the third and fourth rows SS-3 and SS-4 is arranged in alternating transverse locations similar to the lay-out of the first and second rows such that tooling of the first row FS-1 is aligned with the tooling of the fourth row SS-4 in a longitudinal direction with respect to the direction of conveyance of the stock material SM, and the tooling of the second row FS-2 is similarly aligned with the tooling of the third row SS-3.

Figure 4:
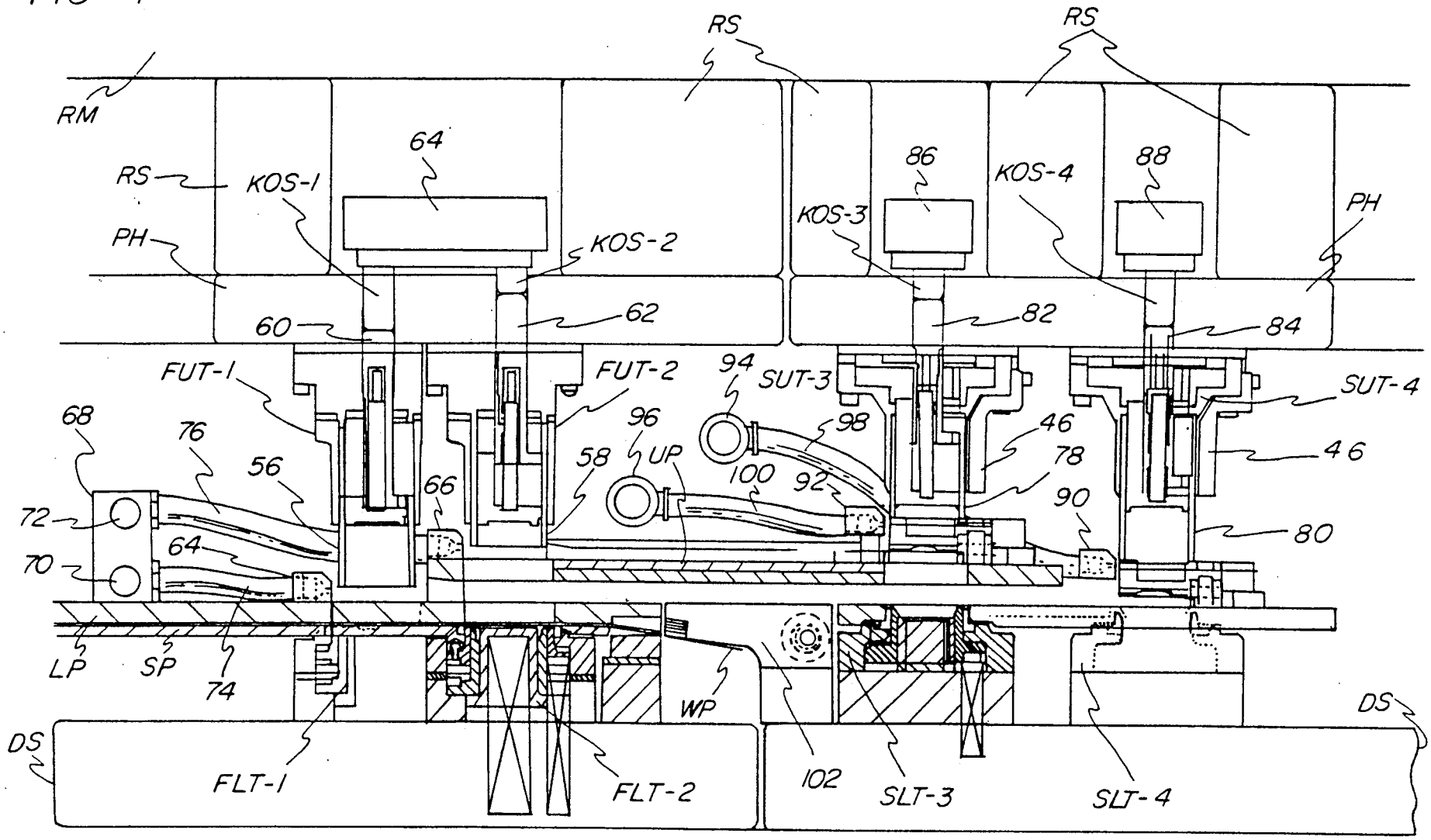
FIG. 4 is an elevational view of the present invention with the ram of the press in an uppermost operational position.

The first station, first row upper and lower tooling FUT-1 and FLT-1, respectively, and second row upper and lower tooling FUT-2 and FLT-2, respectively, which are shown generally in FIG. 4, may be substantially similar in structure and operation to the first station tooling described in commonly assigned U.S. Pat. No. 4,561,280 of Bachman et al, issued Dec. 31, 1985, which is hereby incorporated by reference. The first station tooling of U.S. Pat. No. 4,561,280, as generally shown in FIGS. 1-5 of that reference, forms a generally circular blank from the sheet of stock material and partially forms the blank into a shell preform comprising a substantially flat central panel and an upwardly extending chuckwall about the edge of the panel. In addition, the tooling includes means for forming a partial vacuum along a bottom surface of the tooling such that the partially completed shell or preform will be held against a knock-out and positioner element just prior to propelling the partially completed shell from the first station to the second station.

The second station, third row upper and lower tooling SUT-3 and SLT-3, respectively, and fourth row upper and lower tooling SUT-4 and SLT-4, which are shown generally in FIG. 4, and are substantially similar to the second station tooling shown in FIGS. 6-10 of U.S. Pat. No. 4,561,280 and which forms a countersink at the base of the chuckwall of the partially completed shell by moving the substantially flat central panel upwardly relatively to the chuckwall to produce a completed shell. The second station tooling also includes means for forming a partial vacuum along a bottom surface of the upper portion of the tooling to facilitate lifting and holding the completed shell away from the bottom tooling for transferring the shell out at the press. In addition, the tooling of the second station is positioned along a transfer path for receiving and catching the partially completed shells from the first station tooling during opening of the tooling subsequent to the downstroke forming the partially completed shell or preforms such that the formation of the shells may be completed at the second station during the subsequent downstroke of the press ram.

It should be noted that the upper working surface of each of the first through the fourth row lower tooling FLT-1, FLT-2, SLT-3, SLT-4 is located at substantially the same level as the stock feed level.

Referring to sections I and II in FIG. 3, the transfer paths between the tooling sets of the first and second stations are each formed as substantially horizontal paths defined by a pair of guide rails 10, 12 which guide the partially completed shells from the first row FS-1 of the first station to the fourth row SS-4 of the second station along the lower transfer plate LP, and pairs of guide rails 14, 16 guide the partially completed shells from each of the tooling sets of the second row FS-2 of the first station to the tooling sets of the third row SS-3 of the second station along the upper transfer plate UP. The transfer paths formed by guide rails 10 and 12 are located substantially between the upper and lower plates and partially overlap the movement space of second and third row upper tooling FUT-2, SUT-3 which is defined by the area swept out by the lower portion of each of the upper tool members in their vertical movement toward and away from the lower tooling. Thus, the shell preforms from the first row FS-1 are transferred through a part of the movement space and under at least a portion of the tooling second and third rows FS-2, SS-3 such that the transfer of the shell preforms along the lower plate LP must be performed at a time when the upper tooling for the second and third rows FS-2, SS-3 has cleared the lower transfer path.

Figure 6:
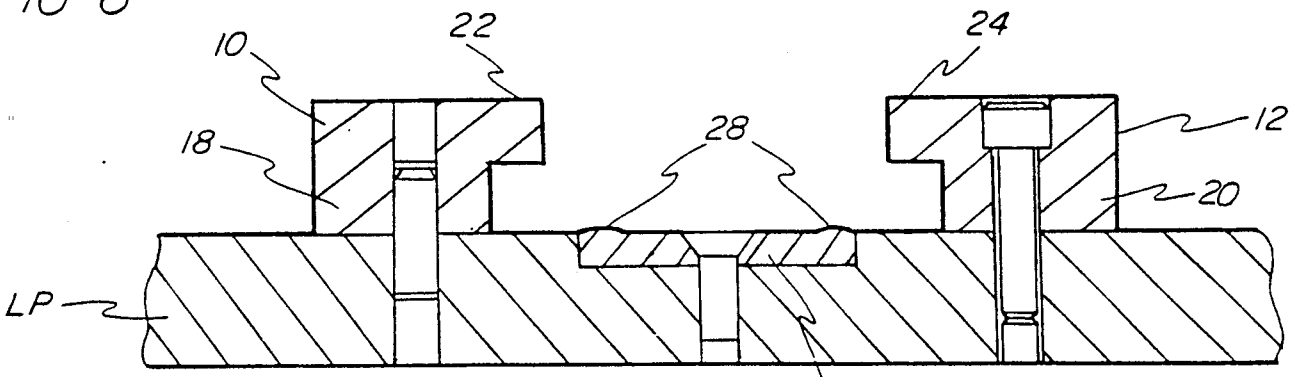
FIG. 6 is a sectional view taken generally along line 6—6 of FIG. 5.
Figure 5:
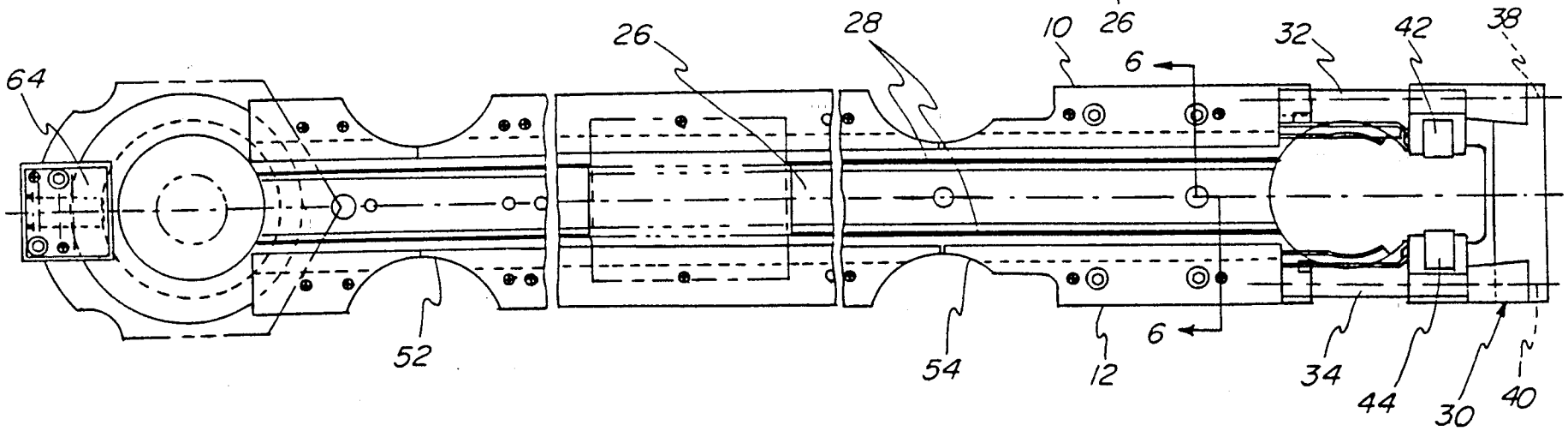
FIG. 5 is a plan view of one of the transfer paths along the lower transfer plate.

Details of the lower transfer path are shown in FIGS. 5 and 6 in which can be seen that the guides 10 and 12 are formed with vertically extending walls 18, 20, respectively, and horizontally extending flanges 22, 24 protruding over the guide path. Although the guide rails 10, 12 are shown attached to the lower plate, it is contemplated that they may alternatively be attached to the bottom surface of the upper plate as is described further in copending application Ser. No. 467,811.

The guide path further includes a low friction plate 26 forming the bottom surface of the guide path. The low friction plate 26 includes a pair of longitudinally extending raised beads 28 which form contact points with the partially formed shells as they travel in free flight from the first to the second stations. Ideally the partially completed shells will have a minimum amount of contact with the boundary surfaces formed by the guides 10 and 12 and the plate 26 such that the shell preforms will not be slowed by frictional forces in their flight from the first to the second stations.

As may be further seen in FIG. 5, the end of each guide path is provided with a catch mechanism 30 for capturing and locating the shell preforms at the second station. The catch mechanism 30 is substantially similar to that shown in U.S. Pat. No. 4,561,280 to Bachman et al. The catch mechanism 30 includes a pair of side members 32, 34 which are mounted to a base member 36 for pivotal movement about horizontal axes 38, 40, respectively, longitudinally aligned with the direction of the guide path. The side members 32, 34 are each provided with a camming wheel 42, 44 which is positioned for engagement with a cam 46 (see FIG. 4) mounted to the upper portions SUT-3, SUT-4 of the second station tooling sets.

The catch mechanism 30 of the present invention differs from the mechanism shown in U.S. Pat. No. 4,561,280 in that an arcuate finger is located within and extends along an interior portion of each of the side portions 32, 34. The arcuate fingers 48, 50 are spring mounted for movement in a direction transverse to the transfer direction of the partially completed shell preforms. Thus, as the shell preforms enter the catch mechanism 30, the fingers 48, 50 move outwardly to allow the shell preforms to enter the mechanism and then partially surround the shell to hold it in place. As the upper portions SUT-3, SUT-4 of the second tooling sets move downwardly, the cam 46 engages the rollers 42, 44 to pivot the side portions 32, 34 outwardly and thus allow the upper portions SUT-3, SUT-4 of the second tooling sets to engage the partially completed shells without contacting the catch mechanism 30.

In order to accommodate the overlap between the transfer path on the first level or lower plate LP and the upper tooling FUT-2, SUT-3 of the second and third rows, the guide rails 10, 12 include cut-out portions 52, 54 which correspond in shape to the outline of the upper tooling. Since the partially completed shell preforms travel along the transfer paths with a minimum amount of contact with the walls of the guides 10, 12, the interruption in the guide path which occurs at the intersection of the guide rails 10, 12 with the tooling location of the second and third rows FS-2, SS-3 will not significantly affect the guiding of the shell preforms as they travel from the first row FS-1 to the fourth row SS-4. Further, it should be apparent that the transfer paths formed by the guide rails 14, 16 on the second level or upper plate UP may be formed with substantially the same structure as that used for the lower transfer paths defined by the guide rails 10, 12 and the low friction plate 26.

Referring now to FIG. 4, it can be seen that the upper tooling FUT-1, FUT-2 of the first and second rows each include knock-out and positioner elements 56 and 58, respectively, having upper portions 60, 62 extending into apertures in the punch holder PH and which function in the same manner as the knock-out and positioner elements described in U.S. Pat. No. 4,561,280.

First and second row knock-out stems KOS-1, KOS-2, respectively, are mounted to a stationary bar 64 extending transversely across the press in the space defined between the bottom surface of the ram RM, the risers RS and the upper surface of the punch holder PH. The bars 64 are positioned and the vertical dimension of the risers is selected such that the ram and punch holder may move between their upper and lowermost positions without contacting the bar 64.

The stems KOS-1, KOS-2, extend from the bottom of the bar 64 and are positioned such that they will enter the apertures containing the portions 60, 62 during an upstroke of the ram and punch holder. As the stems KOS-1, KOS-2 enter the punch holder, they will contact the upper portions 60, 62 of the knock-out and positioner elements 56, 58 and thereby limit the upward movement of elements 56, 58 as the upper tooling FUT-1, FUT-2 is carried upwardly, such that the lower surfaces of the elements 56, 58 carrying the shell preforms from the level of the stock material will be located slightly above first and second transfer levels, respectively.

Each tooling set of the first and second rows FS-1, FS-2 is provided with a nozzle 64, 66, each being mounted on the lower plate LP and having an orifice located at the lower and upper transfer levels for supplying a sudden burst of pressurized gas to thereby apply an edgewise force to the shell preforms held by the knock-out and positioner elements 56, 58 such that the vacuum force holding the preforms to these elements is overcome and the preforms are propelled edgewise toward the second station. The nozzles 64, 66 may operate in substantially the same manner as the gas nozzles of the transfer system disclosed in commonly assigned U.S. Pat. No. 4,770,022, issued to Cook et al on Sept. 13, 1988, and which is incorporated herein by reference.

The nozzles 64, 66 of the present invention are supplied with pressurized gas from a manifold structure 68 which is mounted to and extends transversely across the upper surface of the lower transfer plate LP. The passages 70, 72 are connected to their respective nozzles by means of flexible tubes 74, 76 and at least one valve controls the flow of pressurized gas into each of the passages 70, 72 for energizing the nozzles 64, 66.

It should be noted that the air flow to the lower nozzles 64 is controlled such that it will be effective to propel the preforms to the second station only after the first station tooling has opened sufficiently to locate the upper tooling FUT-1, FUT-2 above the first or lower level transfer path. Similarly, the air flow to the upper nozzles 66 is controlled such that it will be effective to propel the preforms to the second station only after the second row upper tooling FUT-2 is located above the second or upper level transfer path.

The upper tooling SUT-3 and SUT-4 of the third and fourth rows each include form punch and positioner elements 78 and 80, respectively, having upper portions 82, 84 extending into apertures in the punch holder PH and which function in the same manner as the form punch and positioner elements described in U.S. Pat. No. 4,561,280.

Third and fourth row knock-out stems KOS-3, KOS-4 are mounted to stationary bars 86 and 88, respectively, which extend through spaces defined between the bottom surface of the ram RM, the risers RS and the upper surface of the punch holder PH in a manner similar to the bar 64. The function of the stems KOS-3, KOS-4 and the upper portions 82, 84 in positioning the lower surfaces of the form punch and positioner elements 78, 80 is identical to the operation of the stems KOS-1, KOS-2 and upper portions 60, 62 in positioning the lower surfaces of the first station knock-out and positioner elements 56, 58.

Each tooling set of the third and fourth rows SS-3, SS-4 is provided with a nozzle 90, 92, each being mounted on the upper plate UP and having an orifice located above the lower and upper transfer levels, respectively. The nozzles 90, 92 operate in the same manner as the nozzles 64, 66 of the first station and apply an edgewise force in the form of a burst of pressurized gas to forcibly overcome the vacuum force holding the completed shells to the lower surface of the form punch and positioner elements 78, 80 and propel the shells out of the press in the same direction as the shells are conveyed from the first to the second stations.

The nozzles 90, 92 of the second station, in the embodiment shown, are supplied with pressurized gas from a pair of manifold tubes 94, 96 which are mounted to the upper plate UP and which are connected to the nozzles by means of flexible tubes 98, 100. The manifold tubes 94, 96 are each connected to a source of pressurized gas via a control valve in a manner similar to that described for the manifold passages 70, 72 of the first station such that the fourth row nozzles 90 will be effective to propel completed shells from the press only after the upper tooling SUT-3, SUT-4 has separated from the lower tooling SL-3, SL-4 and risen above the first or lower level transfer path and the third row nozzles 92 will only be effective to propel the completed shells from the press after the third row upper tooling SUT-3 has risen above the level of the second or upper transfer path.

It should be noted that although the completed shells of the third row SS-3 must pass between the form punch and positioner elements 80 of adjacent fourth row upper tooling, the shells will not contact the form punch and positioner elements 80 in their passage out of the press since the completed shells are of a significantly smaller diameter than the blank from which they were formed and thus of a small enough diameter to pass freely between the fourth row tooling elements.

In addition, it should be apparent that as the fourth row upper tooling SUT-4 moves to a position above the lower transfer path, the cam members 46 thereon disengage from the camming wheels 42, 44 of the lower level catch mechanism 30 such that these mechanisms are now operational to capture and locate partially formed shells arriving from the first station. Similarly, as the third row upper tooling SUT-3 moves upwardly above the second or upper transfer level, the cam members 46 thereon is disengaged from the cam wheels 42, 44 on the upper level catch mechanisms 30, such that these mechanisms are now operational to capture and locate partially formed shells arriving from the second row FS-2 of the first station.

The stock material SM for forming the shells is conveyed incrementally through the press between the stock support plate SP and the lower transfer plate LP and thus is positioned in a location where it will not interfere with the transfer of the shells from the first to the second station. Further, the web or scrap skeleton WP remaining after the stock material passes through the first station is directed downwardly out of the press at a location between the second and third rows FS-2, SS-3. As the scrap skeleton WP passes from between the lower plate LP and stock support plate SP, it may be cut or chopped transversely of the direction in which the material is conveyed such that smaller pieces are formed. A chopper mechanism 102 appropriate for this purpose is shown pivotally mounted for chopping the material as it passes away from the stock support plate and between the second and third rows of tooling.

As may be seen in FIG. 4, the scrap skeleton WP passes from the rear edge of the stock support plate SP and is directed downwardly by a scrap guide 104 attached to a lower surface of the lower transfer plate LP into a scrap chamber 106 located beneath chopper plates 108 of the chopper mechanism 102. Further, as the scrap WP enters the chamber 106, it passes between the forward lower cutting edges 110 of chopper blades 112 attached to the chopper plates 108 and the rearward upper cutting edges 114 of chopper blocks 116 mounted to die shoe DS.

The chopper plates 108 are attached by pins 118 to support blocks 120 mounted on the die shoe DS such that the chopper plates 108 and their associated blades 112 may pivot relative to the chopper blocks 116. As the cutting edges 110 of the blades 112 pass the cutting edges 114 of the blocks 116 a narrow strip of the scrap skeleton WP is severed along the width of the stock material and is received into the scrap chamber 106.

The chopper plates 108 are positioned with upper surfaces 122 thereof aligned with the plane of the upper surface of the lower transfer plate LP such that the upper surfaces 122 of the chopper plates 108 form a portion of the lower transfer path for the shell preforms. To this end, the upper surface 122 of each of the chopper plates 108 includes a low friction raised bead portions 126 (see FIG. 8) to facilitate guiding the preforms with a minimum of frictional resistance in their passage over the chopper plates.

The chopper plates 108 are actuated to sever the scrap skeleton WP by means of drive bars 128 attached to the punch holder PH and extending downwardly from the ram. Each of the chopper plates 108 is provided with an insert 130 in the upper surface 122 thereof for contacting the lower end of an associated drive bar 128 when the ram moves downwardly to close the tooling (see FIG. 10). Thus, a scrap severing operation takes place with each downstroke of the ram and occurs in between the transfer of shell preforms such that the movement of the drive bar 128 into the transfer path does not interfere with the transfer operation. In addition, it should be noted that the upper transfer plate UP is provided with apertures 132 therein to allow passage of the drive bars 128 through the upper plate UP to the lower transfer level.

Referring to FIGS. 7–9, it can be seen that each chopper plate 108 is provided with a pair of return springs 134 for raising the chopper plate 108 to its uppermost position, and a stop pin 136 having a resilient ring 138 under a head portion thereof is provided for limiting the upward movement of the chopper plate 108 and to properly align the upper surface 122 with the upper surface of the lower transfer plate LP. Further, it should be noted that an additional resilient ring 140 surrounds the pin 136 below the chopper plate 108 to act as a cushion during the downward movement of the chopper plate 108.

A venturi nozzle VN is located at one side of the scrap chamber 106 and creates a vacuum effect through the chamber 106 and out the same side of the press at a high velocity whereby, as the scrap material WP is severed into strips by the chopper mechanism, the strips are ejected from the chamber 106 out the same side of the press through the venturi nozzle VN.

In operation, a sheet of stock material SM is fed into the front of the press at a stock feed level above the stock support plate SP and below the lower transfer plate LP by a set of feed rollers (not shown) such that the stock material SM enters the press in incremental movements synchronized with the movement of the press ram RM. Feed mechanisms for incrementally feeding stock material into a press are per se old and well known in the art and may feed the stock material from a roll of material or, alternatively, a sheet feeder may be provided for supplying individual sheets of stock material.

When the stock material SM overlays the first and second rows of FS-1 and FS-2 of the first station, the ram RM is caused to move downwardly thus moving the upper tooling toward the press bed. As the first station upper tooling FUT-1, FUT-2 contacts the sheet material SM, it cuts out a substantially circular blank from the sheet material SM and continues downwardly to form the blank into a partially formed shell preform.

After a plurality of partially formed shell preforms are simultaneously formed in the first and second rows FS-1, FS-2 of the first station, the ram moves upwardly and thereby causes the upper tooling to separate from the lower tooling and the partially formed shell preforms which are held on a bottom portion of the upper tooling by the partial vacuum which is formed within the knock-out and positioner elements 56, 58. As the upper and lower tooling separate, the preforms are moved from the stock feed level to the first or lower transfer level at which time the upper portion 60 of the knock-out and positioner element 56 of the first row tooling contacts the knock-out stem KOS-1 such that the bottom surface of the knock-out and positioner element 56 positions the shell preforms in alignment with the nozzle 64. The upper tooling continues to separate from the lower tooling until the second row FUT-2 of the first station tooling has cleared the lower level transfer path defined by guide rails 10, 12. When the lower level transfer path is cleared, a stream of pressurized gas supplied by the manifold passage 70 issues from the nozzle 64 with a force sufficient to propel the shell preforms along the lower transfer path where they are captured and located by a lower level catch mechanism 30. Subsequently, the upper portion 62 of the knock-out and positioner element 58 contacts the knock-out stem KOS-2 such that the knock-out and positioner element 58 is held immediately above the second or upper transfer level and the shell preform attached thereto is positioned adjacent to the nozzle 66 at which time a stream of pressurized gas supplied by the manifold passage 72 issues from the nozzle 66 with a force sufficient to propel the shell preforms toward the third row SS-3 of the second station tooling where they are captured and located by upper level catch mechanisms 30.

The catch mechanisms 30 positioned at the third and fourth rows SS-3, SS-4 of the second station hold the shell preforms in position between the upper and lower tooling of the second station tooling sets. In the next downward movement of the press ram RM subsequent to the formation of the blanks and shell preforms the upper tooling moves toward the lower tooling whereby the cam portions 46 engage the cam rollers 42, 44 to pivot the sides 32, 34 of the catch mechanisms 30 outwardly such that the shell preforms are released and may be carried downwardly with the upper tooling SUT-3, SUT-4. The tooling SUT-3, SUT-4 then continues to move toward the lower tooling and complete the formation of the shells at the bottom of the stroke of the ram RM. The ram RM then carries the upper tooling upwardly to a point where the upper portion 84 of the form punch and positioner 80 contacts the knock-out stem KOS-4 such that the completed shell is held in alignment with the nozzle 90 for ejection from the press at a level slightly above the lower transfer level. The manifold 94 is energized to provide pressurized gas to the nozzle 90 to thereby eject the completed shell.

Subsequently, the upper portion 82 of form punch and positioner 78 contacts the knock-out stem KOS-3 such that the completed shell attached to the bottom of the form punch and positioner 78 is held adjacent to the orifice means 92. The manifold 96 is energized to eject the completed shell by means of a pressurized gas stream at a level slightly higher than the upper transfer level for the shell preforms.

It should be noted that while the shells are being completed at the third and fourth rows SS-3 and SS-4 of the second station, additional shell preforms are being formed at the first and second rows FS-1 and FS-2 of the first station in preparation for transfer to the second station where they will be formed into completed shells in the next subsequent stroke of the press ram RM. Thus, each station performs a shell forming operation with each stroke of the press ram RM.

In addition, simultaneously with the formation of the shell preforms in the first station and the completed shells in the second station, the drive bar 128 is actuating the chopper mechanism 102 to sever a strip of scrap material WP which has been conveyed forwardly and downwardly below the stock feed level into the scrap chamber 106.

It should be apparent that the path traversed by the shell preforms traveling from the first row FS-1 of the first station to the fourth row SS-4 of the second station is greater than the distance traversed by the shell preforms from the second row FS-2 of the first station to the third row SS-3 of the second station and thus the transfer time for shells on the upper transfer level will be less than the transfer time for those on the lower transfer level. It should also be apparent that the transfer of the shell preforms from row FS-1 of the first station to the second station is initiated prior to the time at which the second row shell preforms reach the upper transfer level. Thus, although the upper level transfer is initiated later than the first level transfer, the shells on the upper level traverse a shorter distance and therefore will still reach the second station prior to the time at which the upper tooling SUT-3 of second station reaches the upper transfer level in its downward movement for carrying the third row shell preforms toward the lower tooling to form them into a completed shells.

The tooling and transfer lay-out described above provides a means for efficiently using the area of the press bed to produce a large number of shells as well as a means to efficiently use the stock material from which the shells are produced. A press using the above method and apparatus may be set up to use common widths of stock material and it is contemplated that tooling may be typically provided for producing 22, 24 or 27 shell ends per press stroke. Thus at typical nominal press speeds of approximately 235 strokes per minute, as many as 6,345 shells or more may be produced per minute by the present tooling and transfer lay-out.

While the method herein described, and the form of apparatus for carrying this method into effect, constitute preferred embodiments of this invention, it is to be understood that the invention is not limited to this precise method and form of apparatus, and that changes may be made in either without departing from the scope of the invention, which is defined in the appended claims.

What is claimed is:

1. Tooling for a press having a bed and a ram driven toward and away from the bed through operating strokes for the production of shells, as for can ends, comprising:

a punch plate including upper tooling and a die shoe including lower tooling, said punch plate and die shoe having a front and a back and opposite sides and being adapted for mounting on the ram and bed, respectively, of the press for opening and closing action of said tooling;

said upper and lower tooling including first and second stations located at said front and back of said punch plate and said die shoe with said second stations aligned front-to-back with corresponding said first stations;

means for guiding sheet metal material into the press between said upper and lower tooling along a front to back path;

said first tooling stations including a first set of tooling for severing blanks from the sheet material on the path leaving a skeleton of scrap material as the sheet metal material is advanced along the path and shaping the blanks into shell preforms;

means for moving the preforms from the scrap material by lifting the preforms above the path and for moving the preforms to corresponding second stations for completion of the shells;

means defining a scrap passage through said lower tooling and said die shoe including an entrance to said scrap passage at a position between said first station and said second station;

means for guiding the skeleton of scrap material from said first station into said entrance to said scrap passage; and chopper means including (i) a chopper block supported at said entrance under the path of the scrap skeleton and (ii) a chopper plate located over said entrance and above the scrap skeleton on the opposite side of said chopper block from said first station and (iii) a chopper blade means on an edge of said chopper plate adjacent said chopper block and cooperative with said chopper block to reduce the skeleton to small pieces;

said chopper plate having a guiding undersurface for guiding the scrap skeleton downward out of the front to back path to confine those pieces into said scrap passage, said guiding undersurface being located downstream of said chopper blade means.

2. Tooling as defined in claim 1, including a transfer plate providing means for guiding blanks away from said first station.

3. Tooling as defined in claim 2, further including a stock support plate supported by said press bed beneath said transfer plate wherein said stock support plate and said transfer plate guide said sheet material through said first station.

4. Tooling as defined in claim 1, wherein said chopper plate is pivotally supported on said lower tooling.

5. Tooling as defined in claim 2, wherein said chopper plate includes an upper surface for cooperation with said transfer plate to provide a supporting surface for the shell preforms being transferred from said first station to said second station.

6. Tooling as defined in claim 5, further including a chopper drive bar connected for movement by the press ram against said chopper plate thereby to actuate said chopper plate to chop said scrap skeleton into strips during each downstroke of the ram.

7. Tooling as defined in claim 6, wherein a chamber is formed below said chopper plate and extending through said die shoe to receive said scrap strips.

8. Tooling as defined in claim 4, wherein said chamber extends the width of the press and further including means for moving air through said chamber at a high velocity such that said scrap strips are removed from said chamber in the high velocity air flow.

9. A press as defined in claim 1, further including drive bar means carried on said upper tooling and extending, when said tooling is closed by said ram, into contact with said chopper plate to swing said chopper plate downward from its raised position in a scrap severing motion.

10. A method for the production of shells, as for can ends in a ram press having a ram and a base, comprising:

supporting an upper punch plate on said ram and a cooperating lower die shoe on said base;

supporting cooperating upper and lower tooling on said punch plate and said lower die shoe, respectively, and dividing the tooling into first and second tooling stations; said lower tooling having a scrap passage extending downward therethrough between the first and second tooling stations;

feeding sheet metal material through the press between said upper and lower tooling along a front to back path in the press;

severing blanks from the sheet material and leaving a skeleton of scrap material as the material is advanced along the front to back path;

transferring shell preforms from said first to said second station by lifting the shell preforms above the path;

guiding the advancing scrap skeleton out of the front to back path and through a chopping mechanism having chopper blade cooperating with a chopper block into the scrap passage between said first and second stations, the chopping mechanism acting to deflect the scrap skeleton beneath it and downward into the scrap passage by deflecting the scrap skeleton at a position downstream of the chopper block;

then actuating the chopping mechanism after deflecting the scrap skeleton to sever the scrap skeleton into pieces;

withdrawing the scrap pieces from the press through the scrap passage; and guiding the preforms over the chopping mechanism from the first stations to the second stations.

11. A method as defined in claim 10, further including chopping said scrap skeleton in a direction transverse to said front to back path as said scrap skeleton is guided out of the front to back path.

12. A method as defined in claim 11, wherein said scrap chopping step occurs in response to movement of said ram.

13. A method as defined in claim 12, wherein said scrap chopping step occurs in alternating relationship with said shell preform transfer step.

14. A method as defined in claim 11, wherein said scrap strip is removed from said press by a high velocity air flow.

* * * * *